United States Patent [19]

Wu

[11] Patent Number: 4,909,406

[45] Date of Patent: Mar. 20, 1990

[54] LENGTHWISE EXTENDABLE CONTAINER

[76] Inventor: Shin C. Wu, Room 1, 2 Fl., No. 1215, Cung Cheng Road, Chung Ho City, Taipei Hsien, Taiwan

[21] Appl. No.: 326,784

[22] Filed: Mar. 20, 1989

[51] Int. Cl.[4] ..... B65D 6/12

[52] U.S. Cl. ..... 220/8; 220/22.3

[58] Field of Search ..... 220/8, 22.1, 22.2, 22.3, 220/22.5

[56] References Cited

U.S. PATENT DOCUMENTS

| | | | |
|---|---|---|---|
| 3,179,278 | 4/1965 | Cohen | 220/8 |
| 3,463,343 | 8/1969 | Asenbauer | 220/8 |
| 3,494,499 | 2/1970 | Plog et al. | 220/8 |
| 3,622,029 | 11/1971 | Ware | 220/8 |
| 3,691,671 | 9/1972 | Kroll | 220/8 |

*Primary Examiner*—Joseph Man-Fu Moy

*Attorney, Agent, or Firm*—Kolisch, Hartwell & Dickinson

[57] ABSTRACT

A container having a primary container and an extendable drawer. The primary container has a recess at one end of each of its sidewalls. At the top of the recess is a rack having a large number of notches on it. The extendable drawer has a retainer piece which is flexibly urgeable by a pointer which is fixed to a knob into any one of the notches so as to fix the extendable drawer in a desired position.

1 Claim, 3 Drawing Sheets

LENGTHWISE EXTENDABLE CONTAINER

BACKGROUND OF THE INVENTION

This invention relates to a container, such as a pencil box or the like, which is extendable to any required length to add storage space thereto.

In the past, pencil boxes and other like containers were of course available, but they were fixed in size and therefore less flexible to meet the individual user's need.

It is the purpose of this present invention, therefore, to mitigate and/or obviate the above-mentioned drawback in the manner set forth in the detailed description of the preferred embodiment.

SUMMARY OF THE INVENTION

A primary objective of this invntion is to provide a pencil box or similar container which is adjustable in length so as to provide variable storage space.

Another objective of this invention is to provide such a container which is fixable at the desired length by means of a retainer piece, catch, and knob combination.

Further objectives and advantages of the present invention will become apparent as the following description proceeds and the features of novelty which characterize the invention are pointed out with particularity in the claims annexed to and forming a part of this invention.

DETAILED DESCRIPTION OF THE PREFERRED EMBODIMENT

Figure 1:
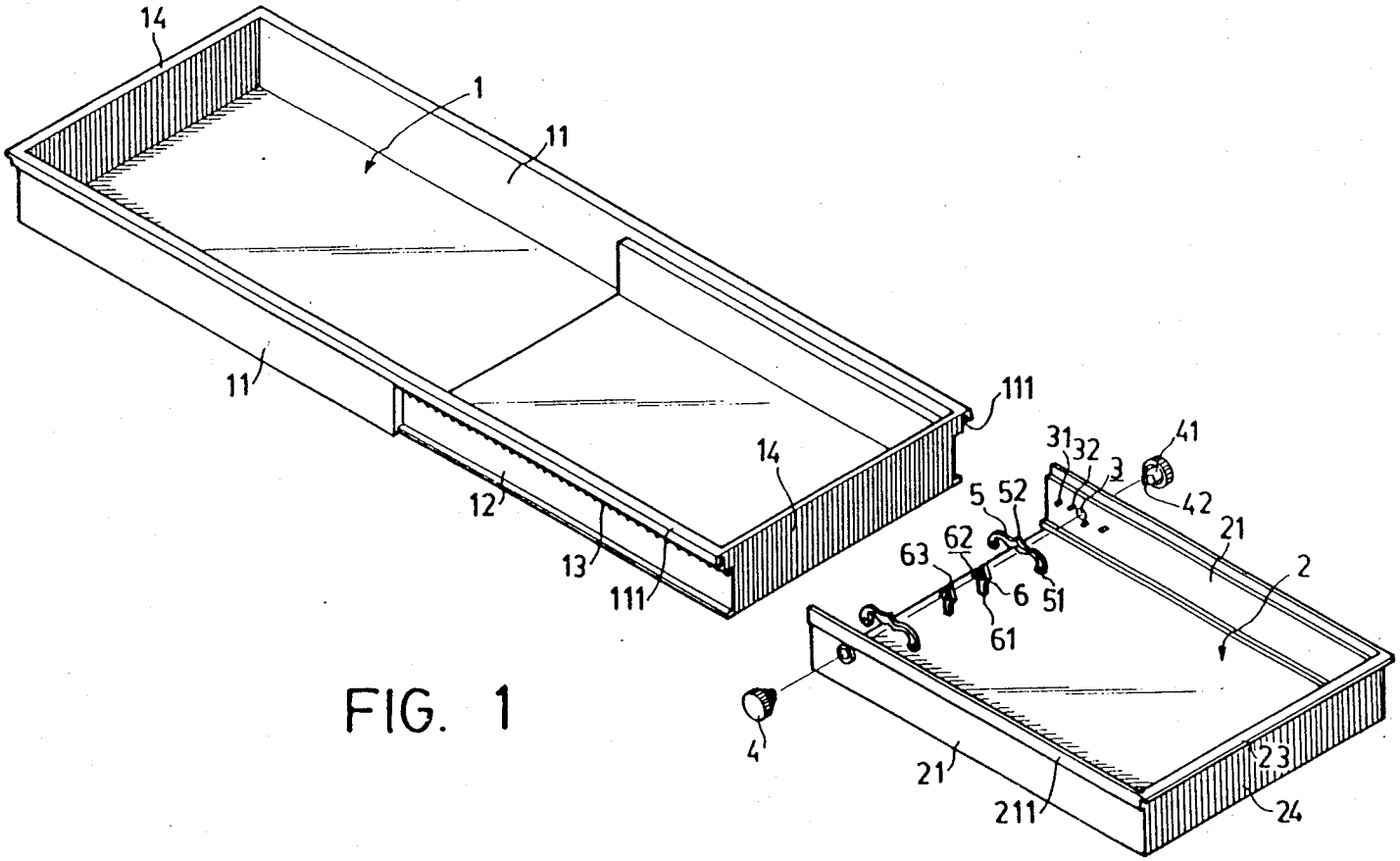
FIG. 1 is a perspective view of a container in accordance with the present invention.

Referring to FIG. 1, it can be seen that the lengthwise extendable container of the present invention comprises a primary container 1, an extendable drawer 2, two knobs 4, a flexible retainer piece 5, and two catches 6.

The primary container 1 is substantially rectangular with two sidewalls 11 and two endwalls 14, each sidewall 11 having a recessed portion 12 with a rack 13 at the upper end thereof and a flange 111 protruding from the uppermost edge therof.

The extendable drawer 2 is also substantially rectangular with two sidewalls 21 and one endwall 24. The endwall 24 has an endgrip 23 at the uppermost end thereof. Each sidewall 21 has an outwardly protruding ledge 211 which is slidable in the flange 111. Each sidewall 21 also has two first protuberances 31 and two second protuberances 32 on respective inner walls thereof proximate to a respective hole 3. Also note that the two first protuberances 31 and the holes 3 are proximate to the open end of the extendable drawer 2, as seen in FIG. 1.

Two knobs 4 are respectively rotatably disposed on the open end of the drawer 2 on each sidewall 21 thereof. The knobs 4 each have an axle portion 41 with a rectangular protrusion 42 thereon, the axle portion 41 of each of the knobs 4 being respectively rotatably disposed on each of the sidewalls 21.

The curved retainer piece 5 has a pointed center portion 52 and an aperture 51 on each distal end thereof. Each of the apertures 51 engages with a respective first protuberance 31 so as to be fixed thereon.

Figure 2:
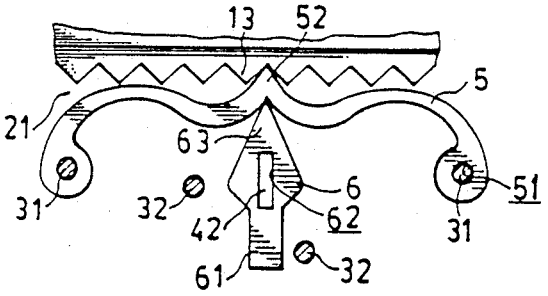
FIG. 2 is a cutaway elevational view showing a rack, retainer piece, and catch in accordance with the present invention, in fixed position.
Figure 3:
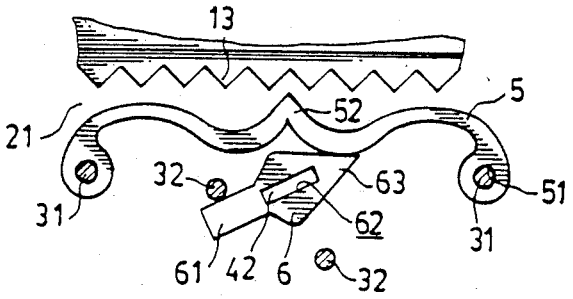
FIG. 3 is a view similar to FIG. 2, but in non-fixed position.

Referring further to FIG. 2 and 3, a catch 6 can be seen. The catch 6 has an extension 61, a pointer 63, and a rectangular slot 62 on the pointer 63 for engaging with the rectangular protrusion 42 so that the catch is rotatable by the knob 4 to urge the center portion 52 against the rack 13, thus fixing the extendable drawer 2. It should be noted that since the curved retainer piece 5 is resilient (springy), it normally urges the pointer 63 of the catch 6 so that the extension 61 of the catch 6 abuts against the upper protuberance 32. The lower protuberance 32 restricts the catch 6 to be turned by the user in only one direction; i.e., the clockwise direction as viewed from FIG. 2. Putting it another way, the second protuberances 32 are set between the first protuberances so as to limit a range of rotation of said catch 6.

Figure 4:
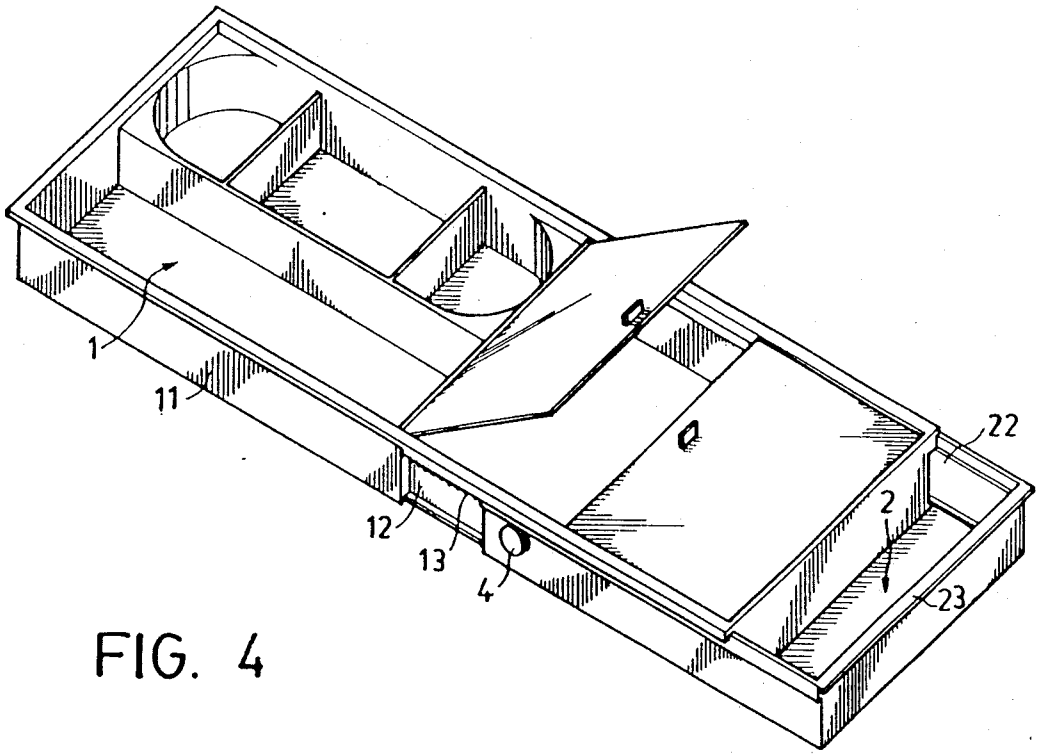
FIG. 4 is a perspective view of a jewelery box in accordance with the present invention, in partially extended position.

Finally, FIG. 4 shows a second embodiment of the present invention, namely an extendable jewelery box in partially extended position in place. In both embodiments, it can be seen that since the center portion 62 is pointed, more or less having an upside down "V" shape, the catch 6 is turnable via knob 4 to urge the point of the center portion 52 against the matching V-shaped notches of the rack 13. Of course, to disengage, the user simply turns the knob 4 from the position shown in FIG. 2 to the position shown in FIG. 3, so that the pointer 63 no longer urges the retainer piece 5 against the rack 13, thereby disengaging the retainer piece 5 therefrom.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A lengthwise extendable container comprising:

(a) a primary container 1, said primary container being substantially rectangular with two sidewalls 11, two endwalls 14, each sidewall 11 having a recessed portion 12 with a rack 13 at an upper end thereof, and a flange 111 protruding from an uppermost edge thereof;

(b) an extendable drawer 2, said extendable drawer 2 being substantially rectangular with two sidewalls 21 and one endwall 24, said endwall 24 having an endgrip 23 at the uppermost end thereof, each sidewall 21 having an outwardly protruding ledge 211 which is slidable in said flange 111, each sidewall 21 also having two first proturberances 31, two second protuberances 32 and a hole 3 on respective inner walls thereof proximate to an open end of said extendable drawer 2;

(c) two knobs 4, each said knob 4 having an axle portion 41 with a rectangular protrusion 42 thereon, said axle portion of each of said knobs 4 being respectively rotatably disposed on each of said hole 3 of sidewalls 21;

(d) a resilient curved retainer piece 5 with a pointed center portion 52 and an aperture 51 on each distal end thereof, each said aperture 51 engaging with a respective said first protuberance 31 so as to be fixed thereon;

(e) a catch 6 with an extension 61, a pointer 63, said pointer 63 having a rectangular slot 62 for engaging with said rectangular protrusion 42 so that said catch 6 is rotatable by said knob 4 to urge said center portion 52 against said rack 13 and thereby fix said extendable drawer 2; and said second protuberances being set between said first protuberances to limit a range of rotation of said catch 6.

* * * * *